US012168849B2

(12) United States Patent
Welch

(10) Patent No.: US 12,168,849 B2
(45) Date of Patent: Dec. 17, 2024

(54) DRYING MACHINE WITH A SIEVE IN THE DRYING CIRCUIT

(71) Applicant: Whirlpool Corporation, Benton Harbor, MI (US)

(72) Inventor: Rodney Welch, McCammon, ID (US)

(73) Assignee: Whirlpool Corporation, Benton Harbor, MI (US)

( * ) Notice: Subject to any disclaimer, the term of this patent is extended or adjusted under 35 U.S.C. 154(b) by 792 days.

(21) Appl. No.: 17/352,529

(22) Filed: Jun. 21, 2021

(65) Prior Publication Data

US 2022/0403582 A1 Dec. 22, 2022

(51) Int. Cl.
*D06F 58/24* (2006.01)
*D06F 58/20* (2006.01)
*D06F 58/26* (2006.01)

(52) U.S. Cl.
CPC ..... *D06F 58/24* (2013.01); *D06F 58/206* (2013.01); *D06F 58/26* (2013.01)

(58) Field of Classification Search
CPC ..... D06F 58/24; D06F 58/26; D06F 58/206
USPC ..... 34/472, 595–610
See application file for complete search history.

(56) References Cited

U.S. PATENT DOCUMENTS 3,032,887 A * 5/1962 Whyte ..... D06F 58/24 62/93
4,447,965 A * 5/1984 Bray ..... D06F 58/30 34/76
6,585,781 B1 7/2003 Roseen
7,434,333 B2 * 10/2008 Yang ..... D06F 25/00 8/149.1
8,112,903 B2 * 2/2012 Favret ..... D06F 58/24 700/275
9,599,398 B2 3/2017 Grunewald
10,612,183 B2 * 4/2020 Graeser ..... D06F 31/005
10,669,667 B2 * 6/2020 Prajescu ..... D06F 58/38
11,352,736 B2 * 6/2022 Seok ..... D06F 58/22
(Continued)

FOREIGN PATENT DOCUMENTS

CN 203128887 U 8/2013
EP 0737772 A2 10/1996
(Continued)

OTHER PUBLICATIONS

European Search Report for European Application No. 22177096.9-1016, dated Nov. 28, 2022 (69 Pages).

*Primary Examiner* — Stephen M Gravini
(74) *Attorney, Agent, or Firm* — Harness, Dickey & Pierce, PLC

(57) ABSTRACT

A dryer or combination washer/dryer machine has a drum (12) and a clothes drying circuit (16) recirculates a drying airflow. An inlet (20, 104) and outlet (22, 106) are connected by a conduit (24). A water vapor path (18) includes a sieve (30) and a compressor (32). The sieve (30) is positioned in the conduit (24). The sieve (30) removes water molecules from the drying airflow to reduce relative humidity in the drying airflow. The compressor (32) is coupled with the sieve to draw the water molecules through the sieve into the compressor (32). The compressor (32) heats the water in the water vapor path (18) and passes it to the drum (12). The water condenses in the drum (12) to heat the drum (12) and air within the drum (12) to dry clothes in the drum (12).

18 Claims, 2 Drawing Sheets

(56) References Cited

U.S. PATENT DOCUMENTS

| | | | | |
|---|---|---|---|---|
| 11,702,791 | B2 * | 7/2023 | Choi | D06F 58/38 34/595 |
| 2004/0045187 | A1 | 3/2004 | Curry et al. | |
| 2019/0292072 | A1 | 9/2019 | Welch | |
| 2022/0403582 | A1 * | 12/2022 | Welch | D06F 58/24 |

FOREIGN PATENT DOCUMENTS

| | | | | |
|---|---|---|---|---|
| EP | 1398407 | A2 | 3/2004 | |
| EP | 1820893 | A1 * | 8/2007 | D06F 58/24 |
| EP | 2399092 | A2 | 12/2011 | |
| EP | 3091120 | A1 | 11/2016 | |
| EP | 3674478 | A1 | 7/2020 | |
| EP | 4108823 | A1 * | 12/2022 | D06F 58/04 |
| GB | 1558913 | A | 1/1980 | |
| WO | WO-0026595 | A1 | 5/2000 | |
| WO | 0203002 | A1 | 1/2002 | |
| WO | WO-2007096252 | A1 * | 8/2007 | D06F 58/24 |

* cited by examiner

DRYING MACHINE WITH A SIEVE IN THE DRYING CIRCUIT

FIELD

The present disclosure relates to laundry appliances and, more particularly, to a dryer or a combination washer/dryer machine that includes a sieve in the drying air circuit.

BACKGROUND

Dryers or combination washers/dryers exist in the art. Current vented dryers exhaust interior air to the exterior environment. This wastes the conditioned air inside the home. Additionally, current vented dryers do not reclaim the energy of evaporation by condensing it back to water again. The significant energy required for an open cycle that requires special high power circuits and plugs, combined with the requirement for a vent, limit where the appliance can be installed. Current heat pump dryers eliminate venting and reduce energy use by reclaiming the energy of condensation. However, they require a high powered compressor and often take considerable time to dry clothes.

Accordingly, it would be desirable to have a dryer or combination washer/dryer with a drying air circuit that increases efficiency even beyond that of a heat pump dryer. Likewise, it is desirable for a dryer or combination washer/dryer machine to be able to run on conventional low voltage circuits. Additionally, it would be desirable to eliminate venting into the outside air.

Accordingly, the present disclosure provides a dryer or combination washer/dryer machine that overcomes the above deficiencies by using a molecular sieve and a compressor deployed in a novel way to separate some of the water vapor from the drying air circuit. The highly concentrated water vapor drawn through the molecular sieve is compressed then condensed on the drum to reclaim both the energy of compression and the energy of condensation. This energy is transferred through the inner wall of the drum to the wet clothing, creating additional evaporation from the clothing. The reduced humidity airflow that had passed by the sieve then enters back into the drum where it can pick up more moisture and repeat the drying circuit.

SUMMARY

This section provides a general summary of the disclosure and is not a comprehensive disclosure of its full scope nor all of its features.

Accordingly, to an object of the disclosure, a combination washer/dryer machine comprises a rotating double-walled drum inside a tub with an access door to insert and remove clothing. A blower recirculates drying air in a circuit. The clothes drying circuit includes an inlet and an outlet into and out of the tub. A conduit connects the inlet and the outlet. A molecular sieve is positioned in the conduit so that the humid air passes by, but not through the sieve membrane. The sieve has pores that are sized to enable water molecules to pass through but it excludes all but a small fraction of a percent of the larger molecules in the air. Thus, this reduces relative humidity in the drying airflow. The inlet of a compressor is connected to the back side of the molecular sieve membrane. The compressor generates a vacuum to draw the water molecules through the molecular sieve into the compressor. During compression, the highly concentrated water vapor becomes superheated steam. The compressor may be a turbo compressor. The compressed water vapor is passed through an air exchange cooler to remove excess heat. The compressed water vapor is passed into the space between the doubled walls of the drum. Here the water vapor is cooled and condensed. The energy of condensation is passed through the inner wall to the clothing to evaporate more water from the clothing. An electrical heater inside the drum can heat the system to operating temperature. A positive displacement pump removes the condensate and non-condensable gasses that accumulate between the walls of the drum. The condensate is stored in a reuse tank, and the non-condensable gasses dissipate into the surrounding air.

Accordingly, to another object of the disclosure, a dryer machine comprises a rotating double-walled drum with an access door to insert and remove clothing. A blower recirculates drying air in a circuit. The clothes drying circuit includes an inlet and an outlet into and out of the drum. A conduit connects the inlet and the outlet. A molecular sieve is positioned in the conduit so that the humid air passes by, but not through the sieve membrane. The sieve has pores that are sized to enable water molecules to pass through but it excludes all but a small fraction of a percent of the larger molecules in the air. Thus, this reduces relative humidity in the drying airflow. The inlet of a compressor is connected to the back side of the molecular sieve membrane. The compressor generates a vacuum to draw the water molecules through the molecular sieve into the compressor. During compression, the highly concentrated water vapor becomes superheated steam. The compressor may be a turbo compressor. The compressed water vapor is passed through an air exchange cooler to remove excess heat. The compressed water vapor is passed into the space between the doubled walls of the drum. Here the water vapor is cooled and condensed. The energy of condensation is passed through the inner wall to the clothing to evaporate more water from the clothing. An electrical heater can heat the system to operating temperature. A positive displacement pump removes the condensate and non-condensable gasses that accumulate between the walls of the drum. The condensate is drained in a reuse tank, and the non-condensable gasses dissipate into the surrounding air.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

DETAILED DESCRIPTION

Example embodiments will now be described more fully with reference to the accompanying drawings.

Figure 1:
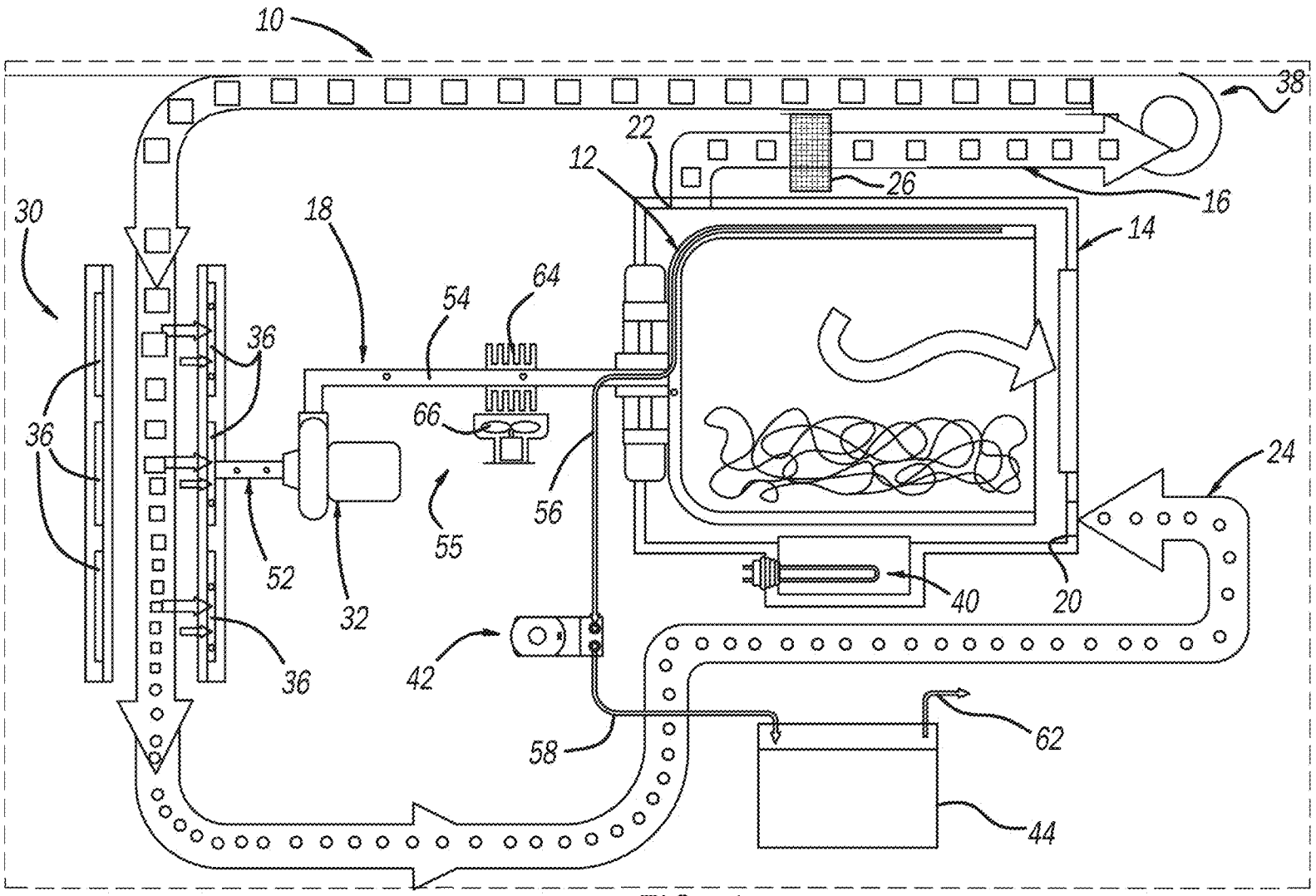
FIG. 1 is a schematic view of a combination washer/dryer machine in accordance with the present disclosure.

Turning to FIG. 1, a combination washer/dryer machine is illustrated and designated with the reference numeral 10. The combination washer/dryer machine 10 includes elements like a dual-walled drum 12, tub 14 and remaining controls, actuators, motors, valves, pumps, and other devices typical in a laundry appliance. The disclosure focuses on the heating and drying of the clothes or textiles within the dual-walled drum 12 and tub 14 during the drying cycle.

FIG. 1 illustrates a drying air circuit 16 and a separated water vapor path 18. The drying air circuit 16 includes an inlet 20, an outlet 22 and a conduit 24 connecting the inlet 20 and outlet 22. The inlet 20 and outlet 22 are coupled with the tub 14 to enable the drying air to pass around the dual-walled drum 12. A filter 26 is positioned along the conduit 24 to filter out lint that may be released from the clothes or textiles within the dual-walled drum 12.

The conduit 24 includes a sieve 30. The sieve 30 is generally an assembly of membranes 36 with molecular sieve properties and a large surface area. The molecular sieve membranes 36 in sieve 30 filter water vapor from the humid air exhausted from the tub 14. The sieve 30 enables smaller water molecules to pass through the sieve 30 while larger gas molecules present in the air are blocked. The sieve 30 removes water molecules from the drying airflow without changing the temperature and pressure of the drying airflow by creating a partial pressure differential of water vapor across the membranes 36. As a non-limiting example, the air entering the conduit 24 at outlet may have a relative humidity of 95% at 55 degrees Celsius (55° C.). At these conditions, the partial pressure of water in the air would be about 15.0 kilopascal (kPa) as it enters the sieve 30. Compressor suction in conduit 52 lowers the pressure of the water vapor extracted by the sieve 30 to 6.3 kilopascal (kPa) the backside of the membranes 36. This creates the partial pressure difference that draws water vapor through the molecular sieve membranes 36. Because pore size in the membranes 36 cannot be controlled to perfection, some small amount of air, less than 0.1%, can be drawn through the membrane 36 in sieve 30 along with the water vapor into conduit 52.

A compressor 32 is coupled with the backside of the sieve 30 along the water vapor path 18 by conduit 52. The compressor 32 may be a turbocompressor that compresses the concentrated water vapor to 15.8 kilopascal kPa), which exists as superheated steam at a temperature of approximately 139 degrees Celsius (139° –C.) at the discharge of the compressor 32 into the water vapor path 18. Further along the water vapor path 18 the compressed water vapor may pass through a cooler 55 where excess heat from compression is removed prior to entry into the dual-walled drum 12. At a pressure of 15.8 kilopascal (kPa), steam condenses into water at 55 degrees Celsius (55° C.). This enables condensation to occur between the walls of dual-walled drum 12 at temperatures that will not damage clothing.

As the drying airflow passes through the sieve 30 the humidity ratio may be reduced by 20% to 30% with only a slight drop in temperature. Thus, without the need to add heat, the drier air enters the tub 14 ready to accept more evaporated moisture into the air generated by the heat of condensation transferred through the drum walls.

A variable speed blower 38 is positioned in the conduit 24. The variable speed blower 38 provides for the movement of the drying airflow through the drying air circuit 16. The speed of the blower 38 can be adjusted by the machine controls with input from sensor(s) placed in conduit 24 to vary drying circuit airflow to maintain a high relative humidity even when drying rates diminish toward the end of the drying cycle. The sensors may measure relative humidity and/or temperature of the air in the drying circuit 16. This is necessary to get the maximum partial pressure of the water vapor in the drying air circuit 16, which drives the water vapor through the membranes 36 in the sieve 30.

An electric heater 40 is positioned in the sump of the tub 14. The electric heater 40 is used during startup to warm the system to an operating temperature of 55 degrees celcius (55°– C.), which is needed to efficiently run the air drying circuit 16. The electric heater 40 may also be used to provide supplemental heat as needed.

The water vapor path 18 is positioned within a housing of the combination washer/dryer machine 10. The water vapor path 18 includes the sieve 30, compressor 32, cooler 55 and double walled drum 12. The combination washer/dryer machine 10 also has a condensate path includes conduit 56, displacement pump 42, conduit 58, and water reuse tank 44.

The double-walled drum 12 is like that disclosed in U.S. Patent Application No. 2019/0292072 entitled "Vapor Compression Distillation Assembly" that is assigned to the assignee of the present application. This patent also describes a method to collect and remove condensate and non-condensable gasses from between the walls of the drum 12. Here, the water vapor condenses on the innermost wall of the double-walled drum 12 creating heat via the heat of condensation. This heat of condensation is conducted into the air and clothing or textiles within the drum 12 through the wall. The temperature in the drum 12 is defined by the pressure within the walls which, in turn, defines the temperature of condensation between the walls and inside the drum 12. The pressure is sustained at a vacuum of 15.8 kilopascal (kPa) by the continued condensation since the specific volume is reduced several orders of magnitude when it changes phase. The condensate and accumulated non-condensable gasses exit the double-walled drum 12 via conduit 56. The conduit 56 is connected with the displacement pump 42. The displacement pump 42 evacuates the condensate and non-condensable gases from 15.8 kilopascal (kPa) up to the atmospheric pressure (101 kilopascal) in the reuse tank 44 through conduit 58. The water reuse tank 44 includes a vent 62 that enables the non-condensable gasses to vent to atmosphere.

Prior to the dry program (i.e.,drying cycle), the combination washer/dryer machine 10 operates to wash the clothes within the drum 12 using a typical wash program. At the conclusion of the wash program, and after the final spin, the wet clothing, the drum 12, and the circulating air are warmed to a desired temperature by the system. Generally, the temperature of the drying air flow is between 40° C. to 60° C. In the present example, the operating air is approximately 55 degrees Celsius (55° C). At this point the compressor 32 is turned on to begin the drying process which continues until the clothing is dry.

The sieve 30, via membranes 36, extracts water vapor and a very small amount of air from the drying airflow. The water vapor and air extracted by the membranes 36 pass into a collection area of the sieve 30 and then into the conduit 52 connected with the compressor 32. The water vapor in the conduit 52 is at approximately 55 degrees celcius (55° C.) at a pressure of 6.3 kilopascal (kPa) with air at less than 0.1%. The compressor 32 compresses the water vapor to a temperature of around 139 degrees Celcius (139° C) and a pressure of approximately 15.8 kilopascal (kPa). The compressor 32 may be a variable speed compressor that is controlled by an algorithm in the machine controls and the outputs of the sensors in conduit 52 and/or conduit 54 to maintain sufficient pressure on the backside of the membranes 36 and between the double walls of the drum 12. Steam (i.e., water vapor) passes through the conduit 54 through the cooler 55, where excess superheat is removed prior to entrance between the walls of the double-walled drum 12. The cooler 55 includes a heat exchanger 64 that is placed on the conduit 54 to prevent overheating. Accordingly, a fan 66 may be present to enhance cooling. Fan 66 may be a variable speed fan thast is controlled by either a thermostat or a machine control algorithm to vary superheat removal based on a rate of water vapor removed in the molecular sieve 30. The water vapor or steam condenses between the walls of the double-walled drum 12 where condensation occurs at nonlimiting example conditions of approximately 15.8 kilopascal (kPa) at 55 degrees celsius (55° C). After the heat of condensation has been moved into the clothing and the air within the drum 12, the condensate and non-condensable gasses that collect between the double walls of drum 12 are removed by the displacement pump 42 through conduit 56. The condensate is carried into the water reuse tank 44 and the air that is present in the condensate vents to atmosphere via the vent 62.

As the clothing tumbles in the dual-walled drum 12, it absorbs the energy of condensation through the inner wall of the dual-walled drum 12 at approximately 55 degrees Celsius (55° C.), causing water to evaporate from the clothing. This water vapor penetrates the clothing and exits out of the open end of the drum 12 into the tub 14 where it mixes with the recirculating drying air that enters the tub 14 through inlet 20.

Figure 2:
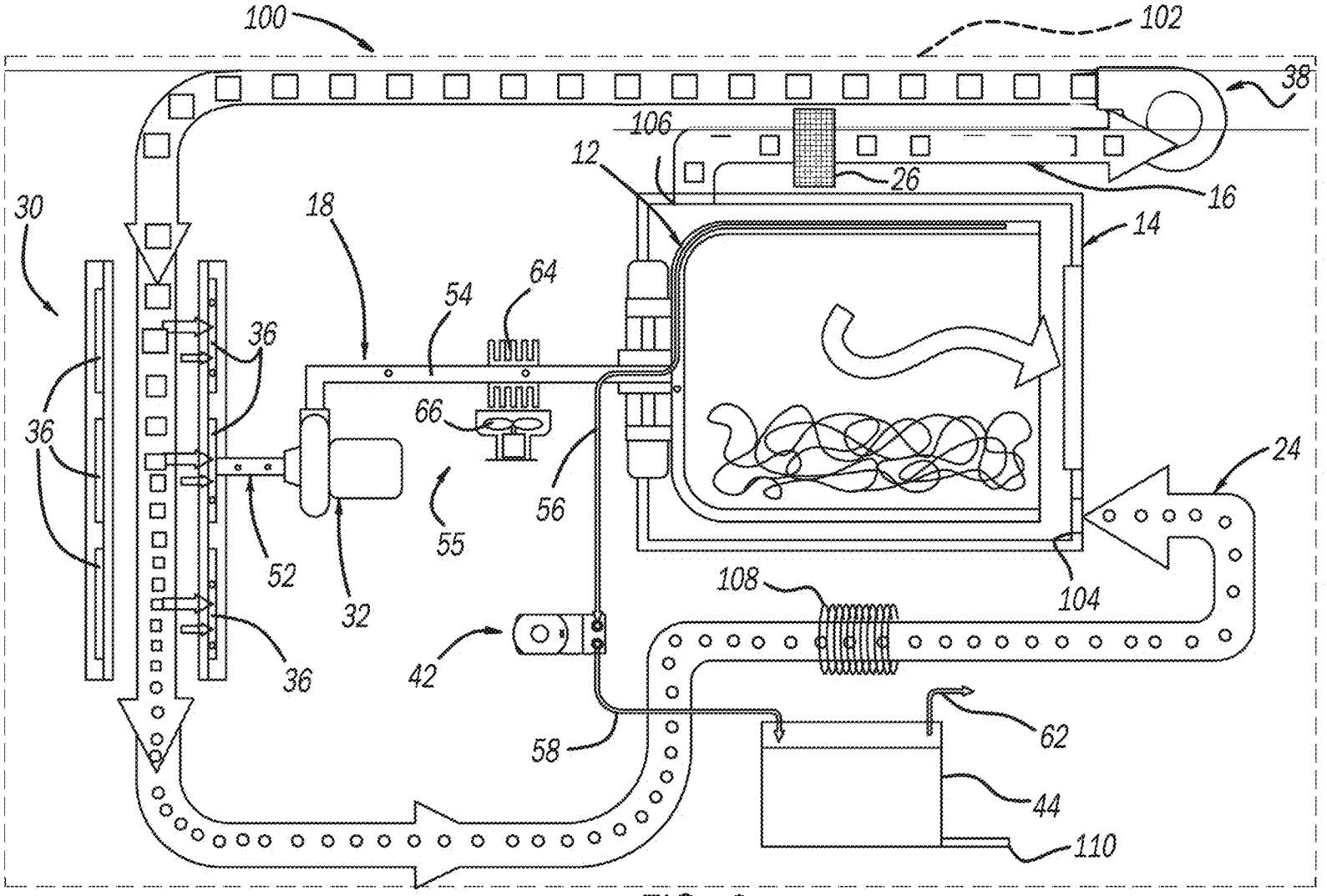
FIG. 2 is a schematic view of a dryer in accordance with the present disclosure.

Turning to FIG. 2, a dryer is illustrated and designated with the reference numeral 100. The elements that are the same as previously disclosed are identified with the same reference numerals. The dryer lacks a tub as in the first embodiment.

The dryer 100 includes elements like a dual-walled drum 12, cabinet 102 and remaining controls, actuators, motors and other devices typical in a laundry appliance. The disclosure focuses on the heating and drying of the clothes or textiles within the drum 12 during the drying cycle.

FIG. 2 illustrates a drying air circuit 16 and a separated water vapor path 18. The drying air circuit 16 includes an inlet 104, an outlet 106 and a conduit 24 connecting the inlet 104 and the outlet 106. The inlet 104 and the outlet 106 are coupled with the tub 14 to enable the water vapor in the dual-walled drum 12 to exit the open end into the tub 14. The circulating air is sealed by retaining the tub 14 around the dual-walled drum 12 to permit the circulating air to enter and exit from the tub 14. A filter 26 is positioned along the conduit 24 to filter out lint that may be released from the clothes or textiles within the drum 12. Alternatively, the tub 14 can be replaced by a front stationary bulkhead (not shown) that covers the an opening of the dual-walled drum 12. This front stationary bulkhead is configured to seal circulating air and can include a felt seal or other means to seal the bulkhead to the dual-walled drum 12.

The conduit 24 includes a sieve 30. The sieve 30 is generally an assembly membranes 36 with molecular sieve properties and a large surface area as described above. The molecular sieve membranes 36 in sieve 30 filters water vapor from the humid air exhausted from the drum 12. The sieve 30 enables smaller water molecules to pass through the sieve 30 while larger molecules are blocked. The sieve 30 removes water molecules from the drying airflow without changing its temperature and pressure by creating a partial pressure differential of water vapor across the membranes 36. As a non-limiting example, the air passing through the outlet 106 may have a 95% relative humidity of 95% and a temperature of 55 degrees Celsius (55° C.) as discussed above. At these conditions, the partial pressure of water vapor in air is about 15.0 kilopascal (kPa) as it enters the sieve 30. The compressor suction in conduit 52 may lower the pressure of the water vapor to 6.3 kilopascal (kPa) on the backside of the membranes 36. This creates a partial pressure difference that draws water vapor through the molecular sieve membranes 36. Because pore size in the membranes 36 cannot be controlled to perfection, some small amount of air, less than 0.1%, can be drawn through the membrane 36 in the sieve 30 along with the water vapor into conduit 52.

A compressor 32 is coupled with the backside of the sieve 30 along the water vapor path 18 by conduit 52. The compressor 32 may a turbocompressor that compresses is concentrated water vapor to 15.8 kilopascal (kPa), which exists as superheated steam at a temperature of approximately 139 degrees Celsius (139° C.) at the discharge of the compressor 32 into the water vapor path 18. Further along the water vapor path 18, the compressed water vapor may pass through a cooler 55 where excess heat from compression is removed prior to entry into the double-walled drum 12. At this 15.8 kilopascal (kPa) pressure, steam condenses into water at a temperature of 55 degrees Celsius (55° C.). This enables condensation to occur between the walls of drum 12 at temperatures that will not damage clothing.

As the drying airflow passes through the sieve 30 the humidity ratio may be reduced by 20% to 30% with only a slight drop in temperature. Thus, without the need to add heat, the drier air enters the tub 14 ready to accept more evaporated moisture into the air generated by the heat of condensation transferred through the drum walls.

A variable speed blower 38 is positioned in the conduit 24. The variable speed blower 38 provides for the movement of the drying airflow through the drying circuit 16. The speed of the blower 38 can be adjusted by the machine controls with input from sensor(s) placed in conduit 24 to vary the drying circuit airflow and maintain a high relative humidity even when drying rates diminish toward the end of the drying cycle. Sensors may measure the relative humidity and/or temperature of the air in the drying circuit 16. This is necessary to get the maximum partial pressure of the water vapor in the drying air circuit 16, which drives the water vapor through the membranes 36 in the sieve 30.

An electric heater 108 is positioned adjacent to the drum 12. The electric heater 108 is used during startup to warm the system to anthe operating temperature of 55 degrees Celsius (55° –C), which is needed to efficiently run the drying air circuit 16. The electric heater 108 may also be used to provide supplemental heat as needed. The heater 108 could also be a gas heater.

The water vapor path 18 is positioned within the cabinet 102 of the dryer 100. The water vapor path 18 includes the sieve 30, compressor 32, cooler 55 and double walled drum 12. The condensate path includes conduit 56, displacement pump 42, conduit 58 and water reuse tank 44.

The double walled drum 12 is like that disclosed in U.S. Patent Application No. 2019/0292072 entitled "Vapor Compression Distillation Assembly" that is assigned to the assignee of the present application. This patent also describes a method to collect and remove condensate and non-condensable gasses from between the walls of the drum 12. Here, the water vapor condenses on the innermost wall of the double walled drum 12 creating heat via the heat of condensation. This heat of condensation is conducted into the air and clothing or textiles within the drum 12 through the wall. The temperature in the drum 12 is defined by the pressure within the walls which, in turn, defines the temperature of condensation between the walls and inside the drum. The pressure is sustained at a vacuum of 15.8 kilopascal (kPa) by the continued condensation since the specific volume is reduced several orders of magnitude when it changes phase. The condensate and accumulated non- condensable gasses exit the double-walled drum 12 via conduit 56. The conduit 56 is connected with the displacement pump 42. The displacement pump 42 evacuates the condensate and non-condensable gases from 15.8 kilopascal (kPa) up to the atmospheric pressure (101 kilopascal) in the water reuse tank 44 through conduit 58. The water reuse tank 44 includes a drain 110 that enables water to drain out of the water reuse tank 44 and a vent 62 that enables the non-condensable gasses to vent to atmosphere.

After washing clothing, the wet clothing is placed into the drum 12 and the circulating air in the dryer is warmed to a desired temperature. Generally, the temperature of the drying air flow is between 40°° C. to 60° C. In the present example, the operating air is approximately 65 degrees Celsius (55° C.). At this point the compressor 32 is turned on to begin the drying process which continues until the clothing is dry.

The sieve 30, via membranes 36, extracts water vapor and a very small amount of air from the drying airflow. The water vapor and air extracted by the membranes 36 pass into a collection area in the sieve 30 and into the conduit 52 connected with the compressor 32. The water vapor in the conduit 52 is at a temperature of approximately 55 degrees Celsius (55° C.) and a pressure of 6.3 kilopascal (kPa) with the air at less than 0.1%. The compressor 32 compresses the water vapor to a temperature of around 139 degrees Celsius (139° C.) and a pressure ofat approximately 15.8 kilopascal (kPa). The compressor 32 may be a variable speed compressor that is controlled by an algorithm in the machine controls and the output of the sensors in conduit 52 and/or conduit 54 to maintain sufficient pressure on the backside of the membranes 36 and between the double walls of the drum 12. The water vapor (i.e., steam) passes through the conduit 54 through the cooler 55, where excess superheat is removed prior to entrance between the walls of the double-walled drum 12. The cooler 55 includes a heat exchanger 64 that is placed on the conduit 54 to prevent overheating. Accordingly, a fan 66 may be present to enhance cooling. Fan 66 may be a variable speed fan that is controlled by either a thermostat or a machine control algorithm to vary superheat removal based on the rate of water vapor removed by the molecular sieve 30. The water vapor or steam condenses between the walls of the double-walled drum 12, where condensation occurs at nonlimiting example conditions of approximately 15.8 kilopascal (kPa) and 55 degrees Celsius (55° C.). After the heat of condensation has been moved into the clothing and the air within the drum 12, the condensate and non- condensable gasses that collect between the double walls of the drum 12 are removed by the displacement pump 42 through conduit 56. The condensate is carried to the water reuse tank 44 through conduit 58 and the air that is present in the condensate vents to atmosphere via the vent 62.

It is noteworthy that the embodiments presented herein do not require the circulated drying air to carry in the heat of vaporization that passes through the clothing thus eliminating a significant amount of air that must pass through the drum and clothing in typical dryers. Rather, the water vapor generated inside the dual-walled drum 12 when the heat of condensation is transferred through the walls of the drum 12 operates to heats the clothing in the drum 12 and evaporate water out of the clothing. Because the heat transferred to the clothes comes from the dual-walled drum 12 and not the circulating air, more clothing can be placed in the dual-walled drum 12 than in present machines without compromising the drying efficiency. Due to the expansion of the water that is coming off the clothing, which is evaporating into a gas phase, the water vapor will move through the clothing to exit the dual-walled drum 12, thereby resulting in significant water vapor flow from the open end of the dual-walled drum 12. This water vapor flow is mixed with the circulating air before entering the molecular sieve 30. Having either a tub 14 or bulkhead with seals to aid in retaining the circulating air will aid in this mixing, along with added mixing due to the flow facilitated by the blower 38. Such a setup may also enable efficient drying capabilities without the need for a large drum, or otherwise enables a larger load of clothing in a typical sized drum. It also permits more efficient drying in a combination washer/dryer unit 10, where a challenge tends to be reconciling the mismatch between the larger size of the drum 12 needed for washing with the smaller size needed for enhancing tumble dry performance.

The foregoing description of the embodiments has been provided for purposes of illustration and description in the context of a combination washer/dryer. It is not intended to be exhaustive or to limit the disclosure from use in other embodiments such as a standalone dryer. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A laundry drying appliance, comprising:

a drum and a tub;

a drying air circuit for recirculating a drying airflow, the drying air circuit includes an inlet and an outlet on the tub; and a drying air conduit connected between the inlet and outlet; and a water vapor path including a sieve, a first conduit a compressor, and a second conduit, wherein the sieve is positioned along the drying air conduit, the sieve configured to removes water molecules from the drying airflow to reduce relative humidity in the drying airflow, wherein the compressor is connected to the sieve by the first conduit and is configured to draws the water molecules in the drying airflow through the sieve and into the compressor, wherein the second conduit fluidly couples the compressor with the drum; and is configured to supply compressed and heated water vapor from the compressor to the drum where the compressed and heated water vapor is condensed to heat the drum through energy of condensation which is conducted through the drum to evaporate moisture from clothes or textiles within the drum.

2. The laundry. drying appliance of claim 1, wherein the compressor is a turbocompressor.

3. The laundry drying appliance of claim 1, wherein the sieve reduces a humidity ratio of the drying airflow.

4. The laundry drying appliance of claim 1, further comprising a blower in the drying air circuit for circulating the drying airflow in the drying air circuit.

5. The laundry drying appliance of claim 1, further comprising an electric heater for heating drying airflow at start-up in the laundry drying appliance or to supply supplemental heat.

6. The laundry drying appliance of claim 1, further comprising a water reuse tank.

7. The laundry drying appliance of claim 1, further comprising a pump to evacuate condensate from a condensing side of the drum.

8. The laundry drying appliance of claim 6, further comprising a pump coupled with the water reuse tank for venting gas from the condenser.

9. The laundry drying appliance of claim 1, wherein the sieve is a molecular sieve with a pore size that is configured to collect and/or pass water molecules.

10. A laundry drying appliance, comprising:

a drum;

a drying air circuit for recirculating a drying airflow, the drying air circuit includes an inlet and an outlet and a drying air conduit connected between the inlet and outlet; and a water vapor path including a sieve, a first conduit, a compressor, and a second conduit wherein the sieve is positioned along the drying air conduit, the sieve configured to removes water molecules from the drying airflow to reduce relative humidity in the drying airflow;

wherein the compressor is connected to the sieve by the first conduit and is configured to draws the water molecules in the drying airflow through the sieve and into the compressor, wherein the second conduit fluidly couples the compressor with the drum; and is configured to supply the compressed and heated water vapor from the compressor to the drum where the compressed and heated water vapor is condensed and heats the drum through energy of condensation which is conducted through the drum to evaporate moisture from clothes or textiles placed within the drum.

11. The laundry drying appliance of claim 10, wherein the compressor is a turbocompressor.

12. The laundry drying appliance of claim 10, wherein the molecular sieve reduces a humidity ratio of the drying airflow.

13. The laundry drying appliance of claim 10, further comprising a blower in the drying air circuit for circulating the drying airflow in the drying air circuit.

14. The laundry drying appliance of claim 10, further comprising a heater for heating the drying airflow at start-up in the laundry drying appliance or to supply supplemental heat.

15. The laundry drying appliance of claim 10, further comprising a water condensate storage/reuse tank.

16. The laundry drying appliance of claim 10, further comprising a pump to evacuate condensate from a condensing side of the drum.

17. The laundry drying appliance of claim 15, further comprising a pump coupled with the water reuse tank for venting gas from the condenser.

18. The laundry. drying appliance of claim 10, wherein the sieve is a molecular sieve with a pore size that is configured to collect and pass water molecules.

* * * * *